US006845977B2

(12) United States Patent
Leveto et al.

(10) Patent No.: US 6,845,977 B2
(45) Date of Patent: Jan. 25, 2005

(54) SYSTEM FOR PREVENTING INCORRECT LOADING OF PRINTER PAPER TRAYS

(75) Inventors: Mark L. Leveto, West Henrietta, NY (US); Henry T. Bober, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 53 days.

(21) Appl. No.: 10/607,183

(22) Filed: Jun. 26, 2003

(65) Prior Publication Data

US 2004/0262835 A1 Dec. 30, 2004

(51) Int. Cl.[7] ..... B65H 1/00
(52) U.S. Cl. ..... 271/171
(58) Field of Search ..... 221/171, 223

(56) References Cited

U.S. PATENT DOCUMENTS 5,573,234 A 11/1996 Petocchi
5,713,570 A * 2/1998 Ouchi ..... 271/242
5,931,456 A * 8/1999 Laidlaw ..... 271/171
6,302,390 B1 10/2001 Clark et al.
6,565,080 B1 * 5/2003 Schaefer et al. ..... 271/171

* cited by examiner

*Primary Examiner*—Donald P. Walsh
*Assistant Examiner*—Kenneth W Bower

(57) ABSTRACT

A printer paper tray improper loading protection system which is automatically moved by the repositioning of a conventional repositionable stack edge guide to restrict improper loading of sheets into the area of the tray which is outside of the proper sheet stacking area for sheet feeding, even though that restricted area varies depending on the selected size of the sheets being properly loaded within the proper sheet stacking area. A customer warning and partial obstruction of the non-feeding restricted area of the tray eliminates confusion as to where the operator should load paper into the tray whenever the tray is accessed, no matter where the tray stack edge guides are positioned for different paper sizes. An accordion-folded, reeled, or other expandable and contractible member operatively connects between the repositionable stack edge guide and the opposite end of the tray, extending above the tray stacking surface therebetween.

2 Claims, 2 Drawing Sheets

SYSTEM FOR PREVENTING INCORRECT LOADING OF PRINTER PAPER TRAYS

Figure 1:
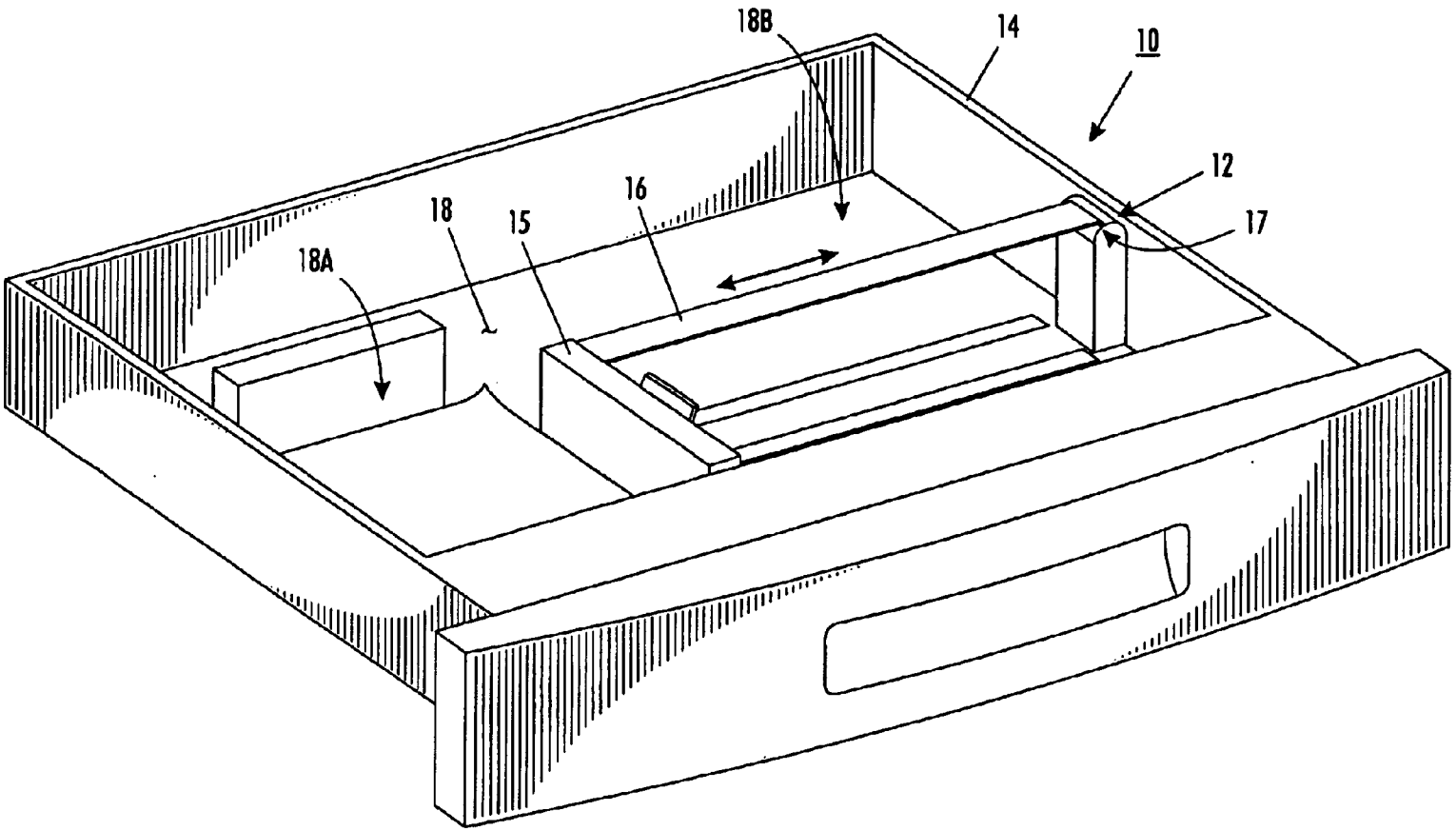

It is desirable, and very common, to provide printers with one or more trays having "universal" print media sheet size loading capability. These can be either sliding drawer type paper trays or fully removable and reinsertable cassette type paper trays. In either case, it is desirable to provide a tray which allows optional operator stacking of a wide range of different paper (print media) sizes within the same tray. Sequential sheet feeding from the stack of print media sheets is then provided with a sheet feeder which operatively overlies the proper stacking position of sheets stacked in the tray when the paper tray is fully inserted into its printer. Such a "universal" type of tray can allow operator staking and feeding of sheets in sizes ranging from, for example, small statement or A5 size sheets up to much larger sheets such as ledger, 11×17 or A3 size sheets. The latter may be stacked on the same tray bottom or other tray stacking surface, but will require a much larger area thereof within the tray.

Typically, the tray has a fixed front edge sheet stacking registration guide surface and an orthogonal fixed side edge guide if side or corner stacking is provided in the tray, or, possibly, two mutually movable rack and pinion interconnected side guides in the case of a center registration tray system. However, there is also typically at least one repositionable stacking end or sheet length guide, and/or repositionable stacking side edge guide, which is upstanding from the tray stacking surface and moveable thereover to different positions for different sizes of sheets being stacked in the tray.

It has been found that a problem can arise when a smaller size print media is, or had been previously, selected, so that the repositionable stack edge guide(s) are moved into that much smaller (typically corner) stacking and feeding area of the large universal type tray. When the repositionable stack edge guide(s) have been so repositioned to their small sheet positions for proper stacking and feeding inside them, the exposed tray area outside of those repositionable stack guides can be as large as or larger than the proper stacking location (in which the stack is properly confined within the fixed and respositionable stack edge guides and thus positioned to engage the sheet feeder). For example, when the repositionable stack edge guides are set for normal letter sized print media fed widthwise, or set for smaller sheets, trays which are also capable of loading and feeding ledger size sheets will have a substantially equal area of exposed tray stacking surface on the other side of the repositionable stack edge guides in which letter sized paper can also be (erroneously) stacked by the operator, but will not feed.

Thus, a printer operator may easily incorrectly load sheets into the tray outside of the proper stacking area, outside of the respositionable stack edge guides. That miss-loaded print media cannot be fed, yet the printer will continue to indicate that it is low on paper or out of paper, even though the operator believes that they have just refilled the tray. This can lead to operator confusion, customer dissatisfaction, and unnecessary service calls.

The disclosed embodiments provide a very low cost, simple, yet effective, solution to this problem, with an improper tray loading inhibiting system which is automatically actuated by the repositioning of the repositionable stack edge guides (length and/or side guides). Yet no sensors, motors or wiring is required. The disclosed system automatically moves to block a restricted area of the tray which is outside of the proper stacking area, even though that restricted area will vary depending on the selected size of the sheets being properly loaded within the proper sheet stacking area. This customer warning and actual partial obstruction or blocking of the area of the tray from which sheets cannot be fed is both physical mechanical) and visible in the disclosed embodiments. The disclosed embodiments can eliminate any confusion as to where the operator should load the paper into the tray whenever the tray is accessed, and whenever the repositionable tray stack edge guides are adjusted for different size papers.

In the disclosed embodiments there is provided an automatically variable dimension stacking obstruction operatively connected between at least one of the repositionable stack edge guides and an opposing end area of the stacking tray, and extending well above the stacking surface therebetween, so as to effectively visibly and mechanically obstruct erroneous operator stacking of print media sheets into that non-feeding area of the stacking tray.

It should be noted that repositionable stack edge guides need necessarily not move perpendicular to the fixed front and side registration walls which are normally forming the other side of the proper sheet stacking area from which paper is fed. See, for example, the stacking tray system shown in Xerox Corp. U.S. Pat. No. 6,302,390 B1, issued Oct. 16, 2001 to L. A. Clark, et al, which is used in Xerox Corporation "iGen3"™ printer paper trays.

Various types of print media sheet stacking trays for sheet feeding are known in the printing art. Some other patent disclosure examples are listed in the above-cited U.S. Pat. No. 6,302,390, and may be incorporated by reference. Since details of sheet feeders and printers, and other features of paper trays, are well known to those skilled in the art, and not relevant here, they need not be repeated herein.

A specific feature of the specific embodiments disclosed herein is to provide a variable print media sheet sizes stacking tray for sheet feeding, which stacking tray has a large stacking surface area and adjustable sheet stacking edge guides for stacking a wide range of different sizes of print media sheets for sheet feeding in a variable size sheet feeding area of said large stacking surface area, wherein said stacking tray has at least one upstanding fixed said sheet stacking edge guide and at least one upstanding repositionable said sheet stacking edge guide which is repositionable relative to said fixed sheet stacking edge guide over a substantial portion of said stacking surface area for stacking different said print media sheet sizes in said variable size sheet feeding area which is formed between one side of said repositionable sheet stacking edge guide and said fixed sheet stacking edge guide and which also defines a non-stacking area of said large stacking surface area on the other side of said repositionable sheet stacking edge guide; wherein a sheet stacking obstruction system is operably connected to said at least one upstanding repositionable said sheet stacking edge guide to reposition therewith, said sheet stacking obstruction system automatically obstructing the stacking of said print media sheets in said defined non-stacking area of said large stacking surface area, said sheet stacking obstruction system automatically varying in length with said repositioning of said at least one upstanding repositionable said sheet stacking edge guide, and said sheet stacking obstruction system extending substantially above said large stacking surface area of said stacking tray.

Further specific features disclosed in the embodiments herein, individually or in combination, include those wherein wherein said variable size sheet feeding area includes one end of said large stacking surface area and said sheet stacking obstruction system is operably connected to variably extend from said at least one upstanding repositionable said sheet stacking edge guide to an opposing end of said large stacking surface area of said tray; and/or wherein said sheet stacking obstruction system is a folding accordion stacking obstruction member which folds or unfolds with repositioning of said at least one upstanding repositionable said sheet stacking edge guide; and/or wherein said sheet stacking obstruction system is a reelable stacking obstruction member which reels or unreels with repositioning of said at least one upstanding repositionable said sheet stacking edge guide.

The term "printer" as used herein broadly encompasses various printers, copiers, multifunction machines or other image reproduction systems, xerographic or otherwise. The term "sheet" or "print media" as used alternatively herein refers to a usually flimsy physical sheet of paper, plastic, or other suitable physical substrate for images.

As to specific components of the subject apparatus or methods, or alternatives therefor, it will be appreciated that, as is normally the case, some such components are known per se in other apparatus or applications, which may be additionally or alternatively used herein, including those from art cited herein. All cited references, and their references, are incorporated by reference herein where appropriate for teachings of additional or alternative details, features, and/or technical background. What is well known to those skilled in the art need not be described herein.

Figure 2:
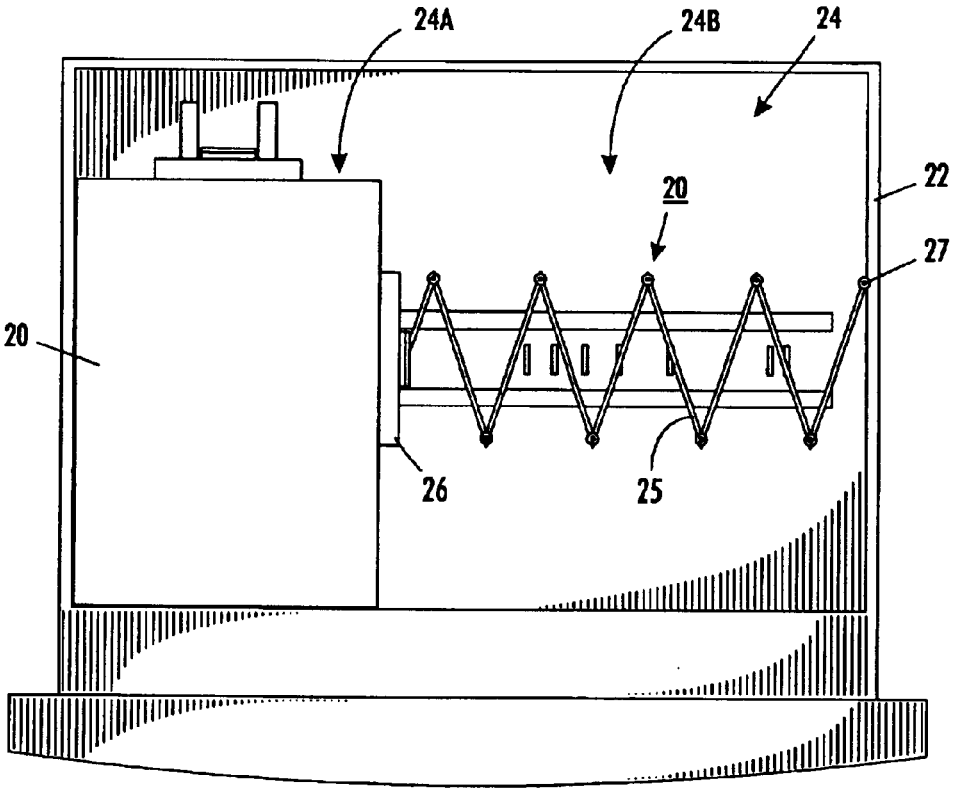

Various of the above-mentioned and further features and advantages will be apparent to those skilled in the art from the specific apparatus and its operation described in the examples below of specific embodiments, including drawing figures (which are approximately to scale) wherein:

FIG. 1 is an upper perspective view of a first exemplary extendible and retractable tape embodiment of the subject system for preventing improper stacking of sheets into an exemplary, otherwise conventional, sheet stacking tray for a printer; and FIG. 2 is a schematic top view of a second embodiment example of the subject proper sheet stacking assistance system, with and extendible and retractable accordion-like blocking system, in an otherwise conventional tray with two moveable (repositionable) sheet stacking edge guides therein providing side and end stack edge guides depending upon the size and orientation of the sheets desired to be stacked in the sheet feeding area, shown in the position for stacking letter size sheets.

Referring to the two examples of the Figures, it will be appreciated that there is present in FIG. 1 a plastic or metal tape type of retractable improper stacking blocking system 10 connecting and extending between a fixed position 12 at the outside end of the tray 14 and the top of the variably repositionable upstanding end stack side edge guide 15. The system 10 provides a tape 16 which retracts or expands from a spring reel 17 depending on the position the stack edge guide 15 is set to. Note that the tape 16 extends substantially above the surface of the tray 14 bottom or stacking surface 18 over the non-feeding improper stacking area 18B which outside of the proper stacking and feeding area 18A. If an operator attempts to stack paper anywhere in that area 18B, it will be mechanically and visibly obstructed by this extending tape 16 overlying that area 18B, irrespective of the varying of that area 18B by the varying position of the stack edge guide 15 from the smallest size sheets up to sheets large enough to fill the entire tray 14.

In contrast, in the embodiment of FIG. 2, the improper sheet stacking obstruction system 20 blocking the excluded (non-loading) area 24B of the tray 22 total stacking area 24 is a simple accordion-folded plastic or metal sheet 25 having a width (folded height) of up to the maximum sheet stacking height of the tray 22 (which typically corresponds to the upstanding height of repositionable side guide 26). One end of the accordion folded member 25 is attached to the outside of the repositionable side guide 26 and the other end of the accordion folded member 25 is attached to an mounting position 27 at the far end of the tray 22, so that the accordion folded member 25 extends therebetween, extending across the variable improper stacking area 24B but never extending into the variable proper stacking area 24A of the tray 22 total stacking area 24.

It will be appreciated that other alternative systems of similarly mounted and/or expandable and contractible improper stacking impeding devices could be provided, such as coil springs or a window shade type of mechanism substantially wider than the tape embodiment of FIG. 1.

Note however that none of the systems disclosed herein need have large spring forces or any other resistance to or interference with normal operation or repositioning of any of the stack edge guides, or their position latching systems, if any. Nor are any sensors, motors or wiring required. Optionally, printed warnings such as "Do Not Stack Here," and/or bright warning colors can be provided on the extendible stacking blocking members.

It will be appreciated that various presently unforeseen or unanticipated alternatives, modifications, variations or improvements may be subsequently made by those skilled in the art which are also intended to be encompassed by the following claims.

What is claimed is:

1. A variable print media sheet sizes stacking tray for sheet feeding, which stacking tray has a large stacking surface area and adjustable sheet stacking edge guides for stacking a wide range of different sizes of print media sheets for sheet feeding in a variable size sheet feeding area of said large stacking surface area, wherein said stacking tray has at least one upstanding fixed said sheet stacking edge guide and at least one upstanding repositionable said sheet stacking edge guide which is repositionable relative to said fixed sheet stacking edge guide over a substantial portion of said stacking surface area for stacking different said print media sheet sizes in said variable size sheet feeding area which is formed between one side of said repositionable sheet stacking edge guide and said fixed sheet stacking edge guide and which also defines a non-stacking area of said large stacking surface area on the other side of said repositionable sheet stacking edge guide; wherein a sheet stacking obstruction system is operably connected to said at least one upstanding repositionable said sheet stacking edge guide to reposition therewith, said sheet stacking obstruction system automatically obstructing the stacking of said print media sheets in said defined non-stacking area of said large stacking surface area, said sheet stacking obstruction system automatically varying in length with said repositioning of said at least one upstanding repositionable said sheet stacking edge guide, and said sheet stacking obstruction system extending substantially above said large stacking surface area of said stacking tray, Wherein said sheet stacking obstruction system is a reelable stacking obstruction member which reels or unreels with repositioning of said at least one upstanding repositionable said sheet stacking edge guide.

2. The variable print media sheet sizes stacking tray for sheet feeding of claim 1, wherein said sheet stacking obstruction system is a folding accordion stacking obstruction member which folds or unfolds with repositioning of said at least one upstanding repositionable said sheet stacking edge guide.

* * * * *